US008845393B2

(12) United States Patent
Mase et al.

(10) Patent No.: US 8,845,393 B2
(45) Date of Patent: Sep. 30, 2014

(54) CUTTING METHOD BY SANDBLASTING

(75) Inventors: Keiji Mase, Edogawa-ku (JP); Shozo Ishibashi, Edogawa-ku (JP)

(73) Assignee: Fuji Manufacturing Co., Ltd., Tokyo (JP)

( * ) Notice: Subject to any disclaimer, the term of this patent is extended or adjusted under 35 U.S.C. 154(b) by 566 days.

(21) Appl. No.: 13/187,670

(22) Filed: Jul. 21, 2011

(65) Prior Publication Data

US 2012/0052773 A1 Mar. 1, 2012

(30) Foreign Application Priority Data

Aug. 25, 2010 (JP) ..... 2010-188402

(51) Int. Cl.
*B24C 1/04* (2006.01)

(52) U.S. Cl.
CPC .. *B24C 1/045* (2013.01); *B24C 1/04* (2013.01)
USPC ..... 451/30; 451/31; 451/38

(58) Field of Classification Search
CPC ..... B24C 3/32; B05D 1/32
USPC ..... 451/29, 30, 31, 37, 38, 39, 40, 41, 59, 451/60
See application file for complete search history.

(56) References Cited

U.S. PATENT DOCUMENTS

| | | | | | |
|---|---|---|---|---|---|
| 4,612,737 | A * | 9/1986 | Adee et al. | ..... | 451/29 |
| 4,872,293 | A * | 10/1989 | Yasukawa et al. | ..... | 451/75 |
| 5,593,528 | A * | 1/1997 | Dings et al. | ..... | 156/154 |
| 5,804,009 | A * | 9/1998 | Dings et al. | ..... | 156/154 |
| 5,833,516 | A * | 11/1998 | De Haas et al. | ..... | 451/29 |
| 6,757,973 | B2 * | 7/2004 | Park | ..... | 29/890.1 |
| 2009/0163115 | A1 * | 6/2009 | Vyas et al. | ..... | 451/31 |

FOREIGN PATENT DOCUMENTS

JP 2008-265224 11/2008

* cited by examiner

*Primary Examiner* — Timothy V Eley
(74) *Attorney, Agent, or Firm* — Oblon, Spivak, McClelland, Maier & Neustadt, L.L.P.

(57) ABSTRACT

A cutting method by sandblasting in which cutting through of a workpiece and/or formation of a through-hole in the workpiece are/is performed by forming a resist on a plate-shaped workpiece and projecting abrasive against the workpiece to cut a portion of the workpiece where no resist is formed, comprises the steps of: forming the resist in a predetermined pattern on a front surface and a back surface of the workpiece symmetrically between the front and back by inkjet printing, and projecting the abrasive against each of the front and back surfaces of the workpiece to make a cut from the front surface side communicate with a cut from a back side at an approximately intermediate position of a thickness of the workpiece.

4 Claims, 3 Drawing Sheets

CUTTING METHOD BY SANDBLASTING

CROSS-REFERENCE TO RELATED APPLICATIONS

This application is based upon and claims the benefit of priority to Japanese Application No. 2010-188402 filed on Aug. 25, 2010.

BACKGROUND OF THE INVENTION

1. Field of the Invention

The present invention relates to a cutting method by sandblasting, and more specifically to a cutting method by sandblasting suitable for the cutting out of parts from a plate-shaped workpiece and the formation of a through-hole on a plate-shaped workpiece.

It should be noted that in the present invention, the term a through "hole" also refers to "groove."

2. Description of the Related Art

In general, the following kinds of processing are performed by cutting:

cutting out (dicing) a cover glass used in a display screen of a mobile phone, cutting through thin-sheet glass for a touch-screen mounted on a liquid crystal display screen or the like, cutting out parts from a plate-shaped workpiece such as other glass, ceramic, metal, a silicon wafer, or the like, and forming a hole or groove on such a workpiece.

Examples of such cutting include cutting out or hole making performed using a grinding wheel rotating at high speed which is followed by finish processing, hole making using a carbide drill or a diamond drill, and the like.

However, these processing methods are not suitable for processing a surface to be processed having a relatively large area. Accordingly, to improve productivity, processing by sandblasting suitable for processing for a relatively large area is also performed.

In the case where the aforementioned dicing, hole making, or the like is performed by sandblasting as described above, a sandblast-resistant protective film called "a resist" which has a pattern formed on portions where cut is not to be made on a surface of the workpiece (hereinafter called "no-cut portions") before sandblasting to protect the no-cut portions.

In the case where the number of workpieces to be processed is relatively low, a process is done by forming the resist on no-cut portions, and a resist made of a metal plate, a ceramic plate, a glass plate, a resin film or the like that has open holes or grooves corresponding to portions where cuts are to be made may be fixed or bonded to a surface of each workpiece. However, in the aforementioned case where a large number of cover glasses for mobile phones, or the like, are to be processed, a resist (photoresist) is formed on each workpiece by lithography using a photosensitive resin.

However, the aforementioned resist formation by lithography is achieved through the following steps of:

attaching photosensitive resin to the entire front surface of a workpiece by an operation such as laminating the entire front surface of the workpiece with a photosensitive resin film; placing a photomask in which openings corresponding to an exposure pattern are formed, on the photosensitive resin; then irradiating the photosensitive resin with light using a light radiation device such as an ultraviolet radiation device or the like, thereby curing the photosensitive resin in portions where no cut is to be made; removing uncured portions of the photosensitive resin by an operation such as immersing the workpiece in a cleaning tank; and thereafter drying the workpiece using a dryer.

As described above, in resist formation by lithography, photosensitive resin is attached to the entire workpiece, and then unexposed portions are cleaned with washing water and discarded together with the washing water. Accordingly, the amount of use of photosensitive resin which is discarded without being used as a resist is large. Thus, the above-described resist formation by lithography does not efficiently use resources, and is not economical.

Also, resist formation by the aforementioned method requires the placing of a photomask, a large light radiation device for exposing an entire surface of a workpiece to light, cleaning after the exposure for removing unnecessary resin, a drying step after the cleaning, and the like. Accordingly, a large number of steps are needed to obtain a sandblast-resistant resist. Further, it is also necessary to prepare equipment for enabling these steps, such as a device for placing a photomask, a light source, a cleaning tank, and a dryer, and to ensure a wide installation place for installing these. Thus, a lot of initial investments are needed.

In order to solve such problems in photoresist formation by photolithography, one method for forming a resist without using photolithography has been proposed in which ink containing an alkali-soluble curable resin is dispensed to a surface of a workpiece in accordance with a pattern of no-cut portions by inkjet printing, and cured to form a sandblast-resistant resist (Japanese Patent Application Laid-Open No. 2008-265224).

In the method described in the aforementioned '265224, ink containing an alkali-soluble curable resin is deposited only on required portions on a workpiece by inkjet printing. Accordingly, excess resin is not used in resist formation. Further, the placing of a photomask, cleaning for removing unexposed excess resin, and drying after the cleaning are not needed. As a result, the number of steps for obtaining a sandblast-resistant resist can be greatly reduced, and a device for placing a photomask and a cleaning tank become unnecessary with the reduction in the number of steps. Also, a light radiation device and the like can also be miniaturized. Thus, the advantage can be obtained that initial investments and the like can be made low.

However, a sandblast-resistant resist needs to have strength enough to remain on a surface of a workpiece and thus to protect the surface of the workpiece from a cut by abrasive until cutting on the workpiece is finished even when abrasive collides against the workpiece at high speed.

Further, for obtaining such sandblast resistance, the invention described in the aforementioned '265224 has limitation on the physical properties and the like of ink to be used to obtain a sandblast-resistant resist. Specifically, the invention uses an alkali-soluble curable resin having a weight-average molecular weight within a predetermined range (Japanese Patent Application Laid-Open No. 2008-265224, paragraph [0023]), for example. Furthermore, in order to obtain sandblast resistance, a large thickness of a resist film is required. In the case where a needed thickness of the resist film cannot be obtained in a single application, ink is applied over a plurality of times (as above '265224, [0023]). Due to this and the like, resist formation takes a long time.

It should be noted that the following problem arises which is common to the method described in the above '265224 and the case where a resist is formed by lithography:

in the case where processing such as cutting out or hole making is performed by sandblasting, though an entire portion not coated with resist is evenly cut in the initial phase of the processing as shown in FIG. 3A, the shape of the cut hole gradually changes, with increasing cut depth, into the shape of a wedge which is deepest at a central portion (FIG. 3B); as the projection of abrasive is further continued to increase the cut depth, abrasive which has entered the cut hole turns around at a bottom portion of the cut hole to scrape away the side surface of the cut hole when being discharged to the outside of the cut hole, and may increase the diameter of the hole to such an extent that the hole reaches a portion under the resist; when the cut is continued until the cut depth is further increased to penetrate the thickness of the workpiece, since the thickness of the workpiece is penetrated at the center of the bottom portion of the cut hole, the side surface of the cut hole has a shape inclined with respect to the front and back surfaces of the workpiece as shown in FIG. 3D, and finish processing is therefore needed.

Also, as described with reference to FIGS. 3A to 3D, it is difficult to form a fine through-hole with high accuracy.

Further, in such cutting by blasting, further improving processability by shortening processing time provides convenience.

Accordingly, the present invention has been made to overcome disadvantages of the above-described prior art, and an object of the present invention is to provide a cutting method by sandblasting in which a resist is formed by inkjet printing to maintain advantages, such as a reduction in the amount of use of resist ink and the simplification of a facility, of the invention described in the aforementioned '265224, and by which necessary sandblast resistance can be obtained even in the case where conditions, such as average molecular weight described in the abovementioned '265224 as being necessary, on physical properties of resin to be used are relaxed or where the film thickness of a resist is reduced.

Another object of the present invention is to provide a cutting method by sandblasting in which even a fine hole or slit can be accurately formed by preventing or relaxing the aforementioned problems occurring in the case where a cut is made by sandblasting, i.e., an increase in the width of a cut hole to the extent that the cut hole extends to under a portion coated with resist and an incisive state due to the inclination of the sidewall of the cut hole, and which can reduce the labor of the aforementioned finish processing such as polishing the side surface of the cut hole after the cut to a plain state.

SUMMARY OF THE INVENTION

In order to achieve the above objective, a cutting method by sandblasting of the present invention in which cutting through of a workpiece and/or formation of a through-hole in the workpiece are/is performed by forming a resist on a plate-shaped workpiece and projecting abrasive against the workpiece to cut a portion of the workpiece where no resist is formed is characterized by comprising the steps of:

forming the resist in a predetermined pattern on a front surface and a back surface of the workpiece symmetrically between the front and back surfaces by inkjet printing, and projecting the abrasive against each of the front and back surfaces of the workpiece to make a cut from the front surface side communicate with a cut from the back surface side at an approximately intermediate position of a thickness of the workpiece.

In the cutting method, the workpiece may be a transparent plate, and a step for forming the resist may comprises the steps of:

after the resist is formed on the front surface of the workpiece, taking an image of the resist formed on the front surface from the back side of the workpiece, and finding a positional coordinate of the resist formed on the front surface from the taken image, and forming the resist on the back surface of the workpiece in accordance with the found positional coordinates.

Furthermore, in the cutting step, projection of the abrasive against the front surface of the workpiece and projection of the abrasive against the back surface of the workpiece may be simultaneously performed, or the cutting step may be performed by projecting the abrasive against any one of the front and back surfaces of the workpiece to cut to an approximately intermediate position in a direction of the thickness of the workpiece, and then projecting the abrasive against the other surface.

The cutting method may further comprise the step of removing the resist attached to the workpiece by cleaning or the like after the cutting step. In the case where the resist is removed by cleaning, a drying step may be performed.

With the above-described configuration of the present invention, a cutting method of the present invention makes it possible to reduce the length of time that a resist is exposed to collision with abrasive, i.e., damage on the resist, to half or less of that for the case where a cut is made only from one surface, since a cut is made from both of the front and back surfaces of a workpiece.

As a result, the sandblast resistance of the resist is relatively improved. Thus, the range of resins usable as resist material can be widened. Also, in the case where a resin having sandblast resistance equivalent to that of the resin described in the abovementioned '265224 is used, the thickness of the resist can be greatly reduced. As a result, complicated work such as accurately applying the resist over multiple times to the same position to ensure a thickness of the resist can be omitted, or the number of coating steps can be reduced.

Further, in the case where a cut is made from one side, when the cutting out and the like of a workpiece is performed by using collision with abrasive by a method such as shown in FIGS. 3B to 3D, the side surface of a cut hole becomes extremely inclined, and after that, finish processing and the like are needed.

Moreover, for a similar reason, it is difficult to make an accurate linear cut corresponding to a resist pattern, and the work of scraping to achieve desired dimensions is needed. In the case where a through-hole or a slit is formed, it is difficult to form a through-hole having a small diameter and a slit having a small width with high accuracy.

In contrast to this, with the method of the present invention, since a cut is made from both surfaces, a side surface formed in a cut hole is at almost right angles with respect to front and back surfaces. Thus, the work of finish processing and the like to be performed thereafter can be reduced, and a machining allowance t (see FIG. 2D) can be reduced. This makes it possible to improve yield in cutting out, and, when a through-hole is formed, to accurately form a through-hole having a small diameter or a slit having a small width by sandblasting.

In particular, in the case where the workpiece is made of a hard, brittle material such as glass, ceramic, or a silicon wafer, when an attempt to form a through-hole by projecting abrasive against one surface is made, the occurrence of chipping increases. This leads to a high fraction defective. However, in the case where abrasive is projected against both surfaces as in the present invention, the occurrence of such chipping can be greatly reduced.

The formation position of the resist on the front surface of a workpiece and the formation position of the resist on the back surface thereof can be aligned with each other with high accuracy by using a transparent plate as the workpiece, taking an image of the resist formed on the front side with, for example, a CCD camera or the like by using a known image recognition technique, and forming a resist on the back side in accordance with coordinates found from the taken image.

Further, in the case where the projection of abrasive in the cutting step is simultaneously performed against the front and back surfaces of a workpiece, processing time can be further shortened.

It should be noted that the projection of abrasive in the cutting step does not need to be simultaneously performed against the front and back surfaces of a workpiece, and may be performed individually. In this case, after the projection of abrasive against one surface is finished, the workpiece is reversed, and abrasive is projected against the other surface. Thus, a known blasting apparatus used in processing in which abrasive is projected against one surface of a workpiece can also be used without any change.

BRIEF DESCRIPTION OF THE DRAWINGS

The objects and advantages of the invention will become apparent from the following detailed description of preferred embodiments thereof provided in connection with the accompanying drawings in which:

FIGS. 2A to 2D are explanatory diagrams showing states of the formation of a cut hole formed in a workpiece by the method of the present invention, in which FIG. 2A shows an early stage of the formation of a cut hole from the front side, FIG. 2B shows a state in which the depth of the cut hole from the front side has reached an approximately intermediate position of the thickness of the workpiece, FIG. 2C shows an early stage of the formation of a cut hole from the back side, and FIG. 2D shows a state in which the cut hole formed from the back side has come to communicate with the cut hole formed from the front side to form a through-hole;

FIGS. 3A to 3D are explanatory diagrams showing states of the formation of a cut hole formed in a workpiece by projecting abrasive only against one surface of a workpiece, in which FIG. 3A shows an early stage of the projection of abrasive, FIG. 3B shows a state in which the cut hole has increased in depth to have the shape of a wedge, FIG. 3C shows a state in which the cut has been progressed by abrasive, and FIG. 3D shows a state in which a through-hole has been formed.

DETAILED DESCRIPTION OF THE PREFERRED EMBODIMENTS

Next, an embodiment of the present invention will be described below with reference to accompanying drawings.

(Overall Configuration)

Figure 1:
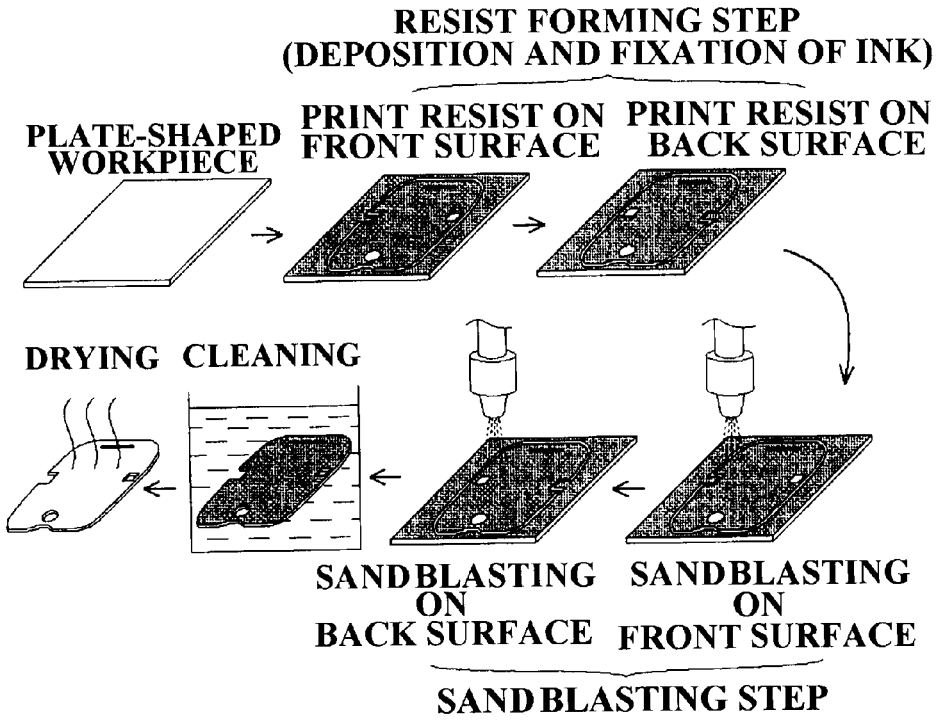
FIG. 1 is an explanatory diagram showing the overall flow of a processing method of the present invention.

As shown in FIG. 1, a cutting method by sandblasting of the present invention includes a "resist forming step" for forming a sandblast-resistant resist on the front and back of a plate-shaped workpiece, and a "sandblasting step" for projecting abrasive against the front and back surfaces of the workpiece after the formation of the resist. Also, in an embodiment shown in FIG. 1, the cutting method further includes a "cleaning step" for removing the sandblast-resistant resist from the workpiece after the sandblasting and for removing the abrasive adhering to the workpiece, and a "drying step" for drying the workpiece after the cleaning.

(Workpiece)

A workpiece to be processed by the cutting method of the present invention only needs to have the shape of a plate, and the material and the like thereof are not particularly restricted. Various kinds of materials such as glass, ceramic, metal, a silicon wafer, and a resin material can be used.

Further, the size, thickness, and the like of the workpiece to be processed are also not particularly restricted. Workpieces having various sizes and thicknesses can be processed.

It should be noted, however, that as described later, in the case where the depositing positions of resist ink on the front and back surfaces of a workpiece are aligned with each other with high accuracy by using an image recognition technique, a transparent plate such as a glass plate or an acrylic plate is used as the workpiece.

It should be noted that the term "transparent" in this case means that the formation position of the resist formed on one surface can be recognized from the other surface with a CCD camera or the like. As long as this condition is satisfied, "semitransparent" is also considered as "transparent" in the present invention.

(Step for Forming Resist)

The aforementioned workpiece undergoes the printing of resist ink in the resist forming step.

It should be noted that before such printing of the resist ink, degreasing and dirt removal on a surface of the workpiece and other preprocessing needed may be performed to improve the adhesion of the resist ink and for other reasons.

Ink to be used as the resist ink may be any ink as long as the ink to be used has flowability enough to be usable in printing with an inkjet head at the time of printing, and is cured and fixed to a surface of the workpiece by being exposed to light or heat, being dried, or the like to exert sandblast resistance. The ink may be ink containing ultraviolet curable or thermosetting resin, or may be ink which is dried by solvent volatilization to adhere to the surface of the workpiece. Ink containing a urethane, epoxy, acrylic, or vinyl chloride resin can be used.

The deposition of the resist ink on a surface of the workpiece in a predetermined pattern is performed by an inkjet printer. The operation of this inkjet printer is controlled by a central processing unit. Ink dots are ejected to predetermined coordinates on a workpiece to be deposited thereon in accordance with a preset resist pattern. These ink dots are cured to be fixed onto the workpiece by being irradiated with ultraviolet light by an ultraviolet radiation device provided in this inkjet printer, by being heated by a heat source, or by other actions. Thus, a predetermined resist pattern can be formed by this set of dots.

Such an inkjet printer may perform ink jetting by using any head type selected from a piezoelectric head and a thermal head. In this embodiment, a piezoelectric multi-nozzle inkjet printer is used which can deposit the resist ink in a desired pattern at high speed.

The printing of the resist ink by the aforementioned inkjet printer includes printing on the front surface of the workpiece and printing on the back surface of the workpiece.

It should be noted that the "front surface" and "back surface" of a workpiece in the present invention are used for convenience to discriminate two flat surfaces provided in a plate-shaped workpiece, and used to roughly mean "one" and "the other" of two flat surfaces of the workpiece.

Accordingly, even if the front and back of a workpiece to be cut in the present invention can be discriminated based on differences in functions and surface finish states, this discrimination between front and back does not necessarily apply to "front surface" and "back surface" written in this specification.

The aforementioned printing of the resist ink on the front surface of a workpiece and the aforementioned printing of the resist ink on the back surface of the workpiece may be simultaneously performed, or one of the printings may be performed first, followed by the other.

In the case where printings on the front and back surfaces are performed nonsimultaneously as described above, the following procedure may be employed:

first, the resist ink is deposited on the front surface; then, the resist ink is deposited on the back surface; and after that, the ink on the front and back surfaces is cured to be fixed. Alternatively, after the resist ink is deposited and fixed on the front surface, the resist ink may be deposited and fixed on the back surface.

It should be noted that as described previously, in the case where a workpiece to be processed is a transparent one such as a glass plate or an acrylic plate, the following procedure may be employed:

the printing of the resist ink is performed on the front surface by using a known image recognition technique; then, an image of the printing position of the resist ink printed on the front surface is taken from the back side with, for example, a CCD camera or the like; coordinates of the printing position of the resist ink on the front surface of the workpiece are found from image data obtained by this image taking; and, in accordance with these coordinates, a printing position on the back surface is determined, or a predetermined printing position is corrected to align the printing position of the resist ink printed on the front surface and the printing position of the resist ink to be printed on the back surface with each other with high accuracy.

It should be noted that as to printing, for example, in the case where the deposition of the resist ink necessary for obtaining a desired film thickness cannot be obtained in a single printing operation, print ink may be applied over a plurality of times to each of the front and back surfaces.

In this case, also, as described previously, the following procedure may be employed: an image of the resist printed last time is taken with a CCD camera or the like to find coordinates by using an image recognition technique, and ink is accurately applied over multiple times to the resist printed last time in accordance with data thus obtained.

With regard to the film thickness of a resist to be formed, required sandblast resistance depends on the processing depth of a workpiece and processing conditions (the material and particle size of abrasive to be used, ejection pressure, ejection speed, and the like) for sandblasting. Accordingly, the film thickness of the resist is determined in accordance with a relative relationship between these conditions. A general film thickness of the resist is approximately 5 μm to 150 μm, for example.

In the case where a resin component contained in the resist ink is an ultraviolet curable resin, the curing of the resist ink is performed by irradiating the resist ink with ultraviolet light from a light source such as an LED, a metal-halide lamp, or a high-pressure mercury lamp. In the case of a thermosetting resin, the resist ink is cured by being heated. In the case of a resin which is cured by being dried by solvent volatilization and the like, the resist ink is cured by being heated as in the case of a thermosetting resin, or by being left to stand for a predetermined time necessary for drying without being heated. Thus, sandblast-resistant resist is formed on each of the front and back surfaces of a workpiece.

(Sandblasting Step)

After the above-described resist formation on the front and back surfaces of the workpiece is completed, sandblasting is performed on this workpiece.

As to the method for projecting abrasive against a workpiece, various types of methods such as the following can be employed: an ejection method in which abrasive is ejected together with compressed gas such as compressed air; a projection method in which abrasive is projected by collision against a rotating impeller; and a projection method in which abrasive is projected by centrifugal force. In this embodiment, the ejection method in which abrasive is ejected together with compressed gas is employed, since processing conditions can be relatively easily adjusted.

As described above, with regard to the configuration of a blasting apparatus for ejecting abrasive together with compressed gas such as compressed air, there are various kinds of methods such as a direct pressure type and a suction type. Any of these types may be used.

As to abrasive to be used, also, selection may be made from materials, particle sizes, shapes, and the like of various kinds of known abrasives used in blasting, in accordance with the material of a workpiece, the degree of processing to be performed on the workpiece, and other conditions.

As to the projection of abrasive against a workpiece, abrasive may be projected against one of the front and back surfaces first and then against the other. Alternatively, abrasive may be simultaneously projected against both front and back surfaces.

In any case, blasting conditions for the front and back surfaces are standardized. Thus, a cut made from the front side and a cut made from the back side meet each other at an approximately intermediate position in the direction of the thickness of the workpiece to perform cutting out or through-hole formation.

(Effects and the Like)

Figure 3:
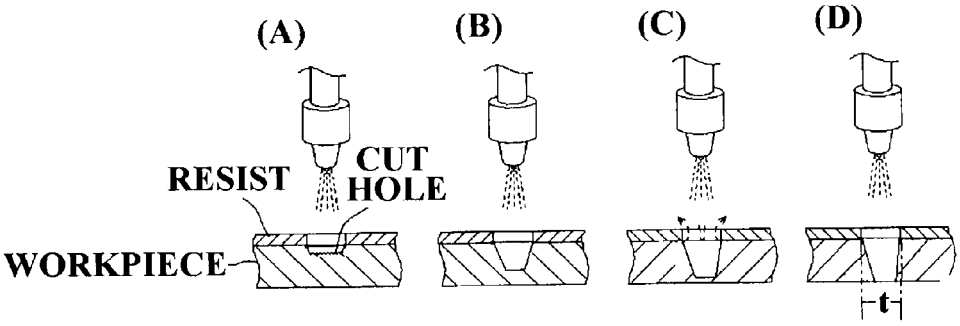

As described with reference to FIGS. 3A to 3D, in the case where the resist is formed only on one surface of a plate-shaped workpiece and where a cut is made by projecting abrasive against this surface until the thickness of the workpiece is penetrated, the abrasive approximately evenly cuts non-resist portions in the initial phase of the cut as shown in FIG. 3A without cutting portions covered with the resist.

When a cut is progressed, and the front and back surfaces are penetrated, a cut hole thus formed is a through-hole which is formed in the shape of a wedge and which reaches the back surface at the center of a bottom portion thereof as shown in FIG. 3D. Accordingly, a greatly inclined sidewall is formed in the through-hole. In order to make the sidewall be a surface at right angles with respect to the front and back surfaces, finish processing needs to be performed to polish and remove this portion.

Figure 2:
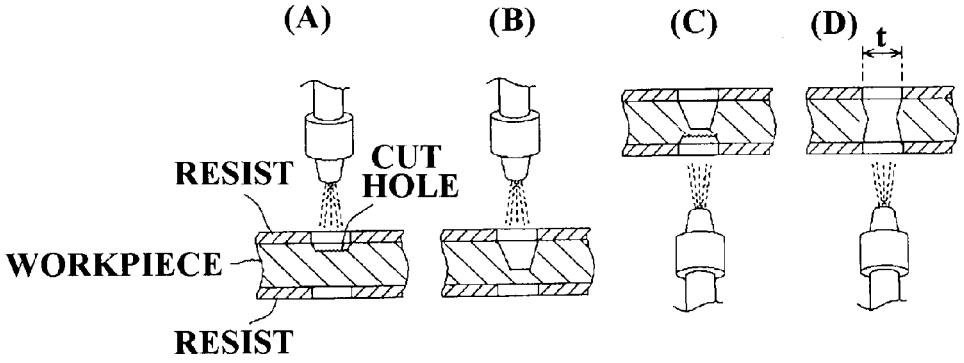

In contrast to this, in the case where the resist is provided on both front and back surfaces of a workpiece and where abrasive is projected against both front and back surfaces as in the present invention, a cut starts in a portion not laminated with the resist in an early stage of the cut, and an approximately linear recessed shape is obtained which has an angle of approximately 15 to 20 degrees from the lower surface of the resist, as shown in FIG. 2A. When the cut is further continued after that, the abrasive is bounced around and/or from the bottom portion and side surface of the cut hole with the progress of the cut to interfere with abrasive from a nozzle. Thus, the speed of the abrasive from the nozzle reduces. Moreover, the situation of this interference becomes more expanded with increasing depth of the recess. Thus, the amount of processing in a central portion is larger than that in a peripheral portion, and therefore processing capability in the width direction reduces. Accordingly, the cut is wedge-shaped or V-shaped.

In this way, in a state in which the depth of the cut hole by projecting abrasive against one side (front side in the example shown in the drawing) reaches approximately half of the thickness of the workpiece, a cut is started from the other side (back surface in the embodiment shown in the drawing) (FIG. 2C) to then meet the cut hole formed from the front side (FIG. 2D). Thus, it is possible to prevent the sidewall of the cut hole from being scraped and to prevent the diameter of the cut hole from being enlarged beyond portions protected by the resist. Also, a cut can be made in correspondence with the printed shape of the resist with high accuracy. Moreover, in the case where the thickness of the workpiece is relatively small, since, for example, the cut hole on the front side shown in FIG. 2A and the cut hole on the back side shown in FIG. 2C come to communicate with each other, the sidewall of the cut hole forms approximately right angles with the front and back surfaces. Further, even in the case where the thickness of the workpiece is relatively large, though a slightly angular portion is formed at an intermediate position in the thickness direction after the formation of a through-hole, an approximately vertical cut is made.

Also, processing time can also be shortened.

It should be noted that since a cut is made from both front and back surfaces of a workpiece as described above in the present invention, the length of time that each resist is exposed to collision with abrasive can be reduced to half or less compared to the case where a cut is made from one side. Thus, the film thickness of resist material formed can be made small, and a material having a lower strength than a material used heretofore can also be selected to be used.

Also, in the case where a cut is made from both front and back surfaces as described above, the occurrence of chipping can be greatly reduced compared to the case where a cut is made only from one surface.

EXAMPLE

An example of cutting according to the method of the present invention will be described below.

(Workpiece)

a glass plate of length 90 mm×width 90 mm×thickness 0.7 mm.

(Details of Processing)

Figure 4:
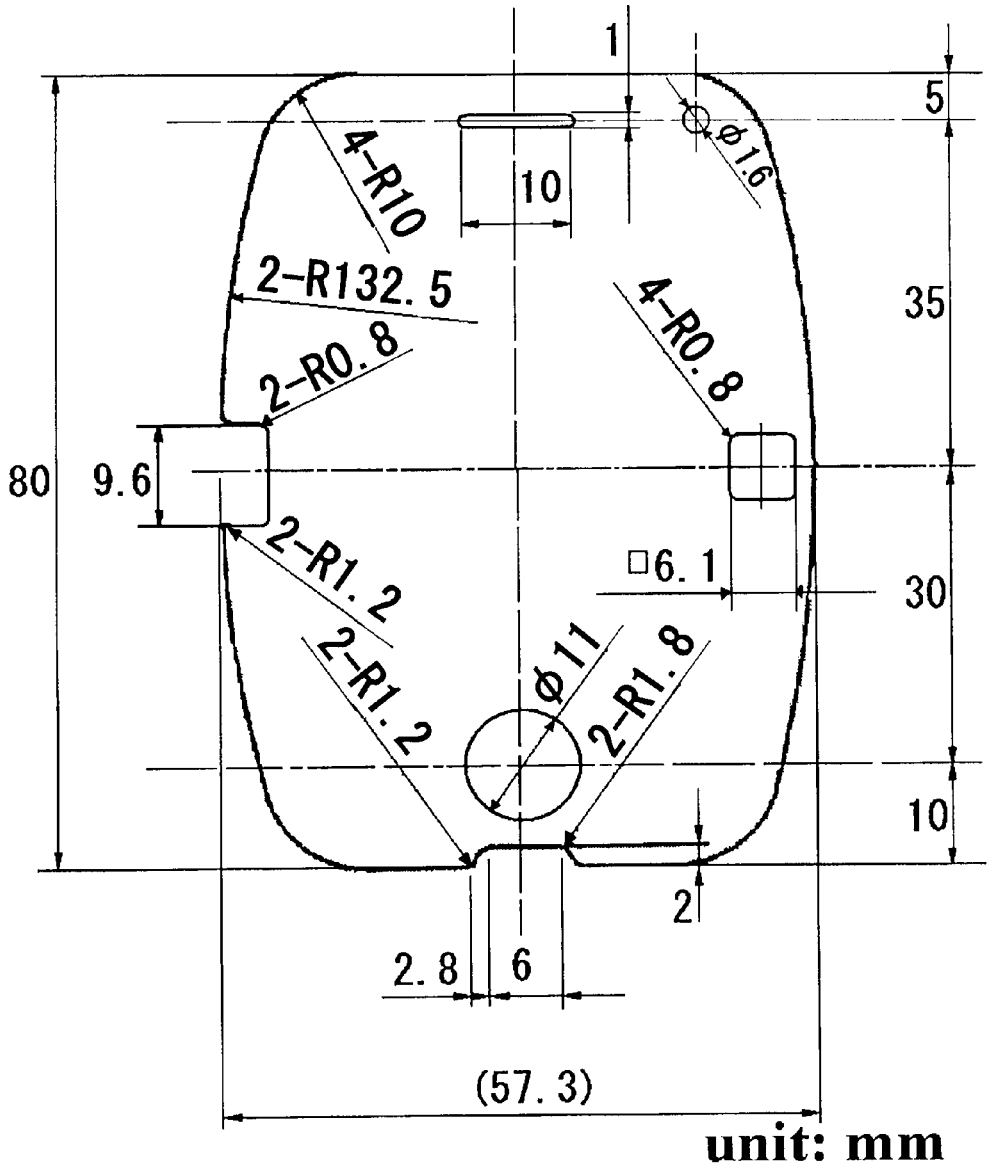
FIG. 4 is a view for explaining a test pattern used in processing in an example (values in the drawing indicate dimensions (mm)).

The above-described glass plate was processed in a test pattern shown in FIG. 4. Further, a through slit of width 0.8 mm×length 10 mm and a through-hole having a diameter of 0.8 mm were formed in a similar glass plate.

(Resist Formation)

(1) Resist Ink

As resist ink, "UVink F-200" manufactured by Mimaki Engineering Co., Ltd. was used. The composition of this resist ink is shown in Table 1.

TABLE 1

Composition of Resist Ink

| Ingredient | Content (%) |
|---|---|
| Tetrahydrofurfuryl Acrylate | 10-30 |
| Isooctyl Acrylate | 10-25 |
| Isobornyl Acrylate | 10-25 |
| Modified Amine Acrylate Oligomer | 5-20 |
| Aliphatic Urethane Acrylate | 10-20 |
| 1,6-Hexanediol Diacrylate | 1-10 |
| Benzophenone | 1-10 |
| Diphenyl(2,4,6-Trimethylbenzoyl)Phosphine Oxide | 1-10 |
| Acrylic Ester | 1-5 |

(2) Method for Forming Resist

As a printing apparatus, an inkjet printer having an inkjet head which is a Drop-on-Demand piezoelectric head (1200×1200 dpi) was used.

On the front surface of a workpiece fixed in place by suction using a suction device in the form of suction cups, the aforementioned resist ink was ejected to and deposited on no-cut portions, and was then cured and fixed on the workpiece by being irradiated with UV using a UV radiation device incorporated in the inkjet printer.

After the resist formation on the front surface, the workpiece was reversed to be fixed in place by vacuum suction similarly, and an image of the formation position of the resist provided on the front surface was taken from the back side with a CCD camera incorporated in the printer. Further, the formation position of the resist on the front surface was recognized as coordinates based on this taken image, and the resist ink was deposited in a predetermined pattern on the back surface in such a manner that the position of the resist to be formed on the back surface is prevented from being displaced from the position of the resist formed on the front surface, and was cured by being irradiated with UV to be fixed.

(3) Sandblasting

As a sandblasting apparatus, "Pneuma-Blaster SGK-2" manufactured by Fuji Manufacturing Co., Ltd. was used. A silicon carbide-based abrasive ("Fujirandom" #320 (average particle size is 20 μm) manufactured by Fuji Manufacturing Co., Ltd.) was ejected with an ejection pressure of 0.4 MPa and an ejection distance of 150 mm. Here, the term "ejection distance" refers to the distance between the tip of an ejection nozzle and the front surface of a workpiece.

As to the ejecting of the abrasive, when ejecting against the front surface brought the cut depth to ½ (0.35 mm) of the plate thickness, which was 0.7 mm, of a workpiece, the workpiece was reversed, and the abrasive was ejected against the back surface. Thus, a cut portion from the back side was made to communicate with a cut portion from the front side at an approximately intermediate position of the thickness of the workpiece, and the workpiece was penetrated.

(4) Removal of Resist

The workpiece processed as described above was immersed in warm water at 40° C. to remove the resist material, and then dried.

(Discussion)

In the above-described cutting method of the present invention, operating time can be greatly shortened compared to the case where a cut is made by blasting only from the front side.

Moreover, in the case where cutting out is performed by blasting only from the front side, since a peripheral portion of a workpiece after cutting out has an inclined shape as described with reference to FIG. 3D, finish processing is needed to scrape away this portion until the peripheral portion becomes plain or vertical. However, in the case where processing was performed by the method of the present invention, it was confirmed that such an inclination does not occur, that an approximately plain shape was obtained, and that the labor of finish processing can be greatly reduced.

Further, the occurrence of chipping was not observed in a workpiece processed by the method of the present invention. Also, it was confirmed that the occurrence of chipping was greatly reduced compared to the case where blast is performed against one surface of a workpiece.

Thus the broadest claims that follow are not directed to a machine that is configured in a specific way. Instead, said broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described;

What is claimed is:

1. A method by which cutting through a transparent workpiece and/or formation of a through-hole in the workpiece occurs, the method comprising:

forming a resist in a predetermined pattern on a front surface of a transparent workpiece by inkjet printing;

after the resist is formed on the front surface of the workpiece, taking an image of the resist formed on the front surface from a back side of the workpiece;

finding positional coordinates of the resist formed on the front surface from the taken image, and forming the resist on a back surface of the workpiece in accordance with the positional coordinates by inkjet printing; and projecting an abrasive against each of the front and back surfaces of the workpiece to make a front cut from a front surface side and a back cut from a back surface side at an approximately intermediate position of a thickness of the workpiece, said front cut and said back cut communicating to form a through-cut through the workpiece and/or a through-hole in the workpiece.

2. The method of claim 1, wherein in the making of the front and back cuts, the projecting of the abrasive against the front surface of the workpiece and the projecting of the abrasive against the back surface of the workpiece occur simultaneously.

3. The method of claim 1, wherein the making of the front and back cuts occurs by projecting the abrasive against any one of the front and back surfaces of the workpiece to cut to the approximately intermediate position in a direction of the thickness of the workpiece, and then projecting the abrasive against the other surface.

4. The method of claim 1, further comprising:

removing the resist attached to the workpiece after the making of the front and back cuts.

* * * * *